United States Patent [19]

Oneyama et al.

[11] Patent Number: 4,616,476

[45] Date of Patent: Oct. 14, 1986

[54] CYLINDER DRIVING APPARATUS

[75] Inventors: Naotake Oneyama, Kashiwa; Akihisa Yoshikawa, Mastudo, both of Japan

[73] Assignee: Shokestu Kinzoku Kogyo Kabushiki Kaisha, Tokyo, Japan

[21] Appl. No.: 599,592

[22] Filed: Apr. 12, 1984

Related U.S. Application Data

[63] Continuation of Ser. No. 266,498, May 22, 1981, abandoned.

[30] Foreign Application Priority Data

May 30, 1980 [JP] Japan ..... 55-76064

[51] Int. Cl.[4] ..... F15B 1/02; F15B 13/043; F15B 13/044

[52] U.S. Cl. ..... 60/414; 60/407; 60/415; 91/436; 91/459; 91/461; 91/463; 91/465; 137/596.16

[58] Field of Search ..... 60/407, 409, 412, 413, 60/414, 415, 417, 470, 472; 91/436, 459, 461, 463, 465; 137/596.16

[56] References Cited

U.S. PATENT DOCUMENTS

| | | | |
|---|---|---|---|
| 2,578,959 | 12/1951 | Yarborough | 60/414 |
| 2,641,106 | 6/1953 | Jelinek | 60/417 |
| 2,714,874 | 8/1955 | Hart | 91/463 |
| 3,534,553 | 10/1970 | Norton et al. | 60/407 |
| 3,648,458 | 3/1972 | McAlister | 60/415 |
| 3,795,177 | 3/1974 | Cryder et al. | 91/436 |
| 3,865,218 | 2/1975 | Jones, Jr. | 91/459 |
| 4,281,682 | 8/1981 | Satoh | 137/596.17 |
| 4,414,808 | 11/1983 | Benson | 60/414 |

*Primary Examiner*—Charles T. Jordan
*Assistant Examiner*—Richard Klein
*Attorney, Agent, or Firm*—Oblon, Fisher, Spivak, McClelland & Maier

[57] ABSTRACT

A cylinder driving apparatus, wherein a head chamber and a rod chamber of a cylinder for driving a load upwardly and downwardly are communicated with a pressure accumulation tank by way of a balance pipeway equipped with an electromagnetic proportional flow control valve and a recycling pipeway equipped with a pressure control valve mechanism, respectively, and the load is driven by feeding air at reduced pressure to the rod chamber or discharging it to the external atmosphere by way of the pressure control valve mechanism while applying air pressure into the head chamber of the cylinder against the load by way of the electromagnetic proportional flow control valve for adjusting the driving speed.

8 Claims, 9 Drawing Figures

CYLINDER DRIVING APPARATUS

This application is a continuation of application Ser. No. 266,498, filed May 22, 1981 now abandoned.

BACKGROUND OF THE INVENTION (1) Field of the Invention

This invention concerns a cylinder driving apparatus for driving a load upwardly and downwardly.

(2) Description of the Prior Art

In conventional cylinder apparatus of general tgpe employed so far, in order to drive heavy load, double acting cylinders of large diameter capable of generating driving force greater than the weight of the load have been used. This, however, requires an extremely large amount of air to be charged and discharged into and from the cylinder for driving the load. Further, since no fine control is possible for the amount of air charged and discharged in the use of the large diameter cylinder, various defects have resulted. For instance, it provides an imbalanced property, that is, slow starting for the upward stroke and rapid starting for the downward stroke in the control for the driving of the load, smooth deceleration is difficult midway in the stroke and is accompanied by vibrating bounding actions, violent collision occurs at the stroke end and emergency stop can be attained only after the damping of vibrations.

SUMMARY OF THE INVENTION

This invention has been made in order to eliminate the foregoing defects and a principle object of this invention is to provide a cylinder driving apparatus capable of effectively controlling the driving of a load with an extremely small amount of air consumption, by releasing only low pressure air in a rod chamber but not releasing high pressure air in a head chamber to external atmosphere during one reciprocation of a cylinder.

Another object of this invention is to provide a cylinder driving apparatus capable of attaining more uniform response during heavy load operation and during reciprocating strokes by moderating the pressure rise in a tank system that communicates a head chamber and a pressure accumulation tank by partially recycling pressurized air flowing backwardly from the head chamber to the pressure accumulation tank upon downward movement of the cylinder into the rod chamber to thereby significantly moderate the changes in the output from the cylinder.

A further object of this invention is to provide a cylinder driving apparatus capable of adjusting the upward and downward speeds of the load, attaining smooth speed and emergency stopping during reciprocating strokes and enabling buffered stopping at the stroke end.

In order to attain the foregoing objects, according to this invention, a head chamber of a cylinder for driving a load upwardly and downwardly is communicated with a pressure accumulation tank by way of a balance pipeway equipped with an electromagnetic proportional flow control valve which provides a flow rate in proportion to a valve energizing current, and a rod chamber of the cylinder and the pressure accumulation tank are communicated to each other by way of a recycling pipeway equipped with a pressure control valve mechanism adapted to alternately communicate the rod chamber with the pressure accumulation tank and external air and cause the air in the pressure accumulation tank to flow into the rod chamber while reducing its pressure upon communication of the rod chamber with the pressure accumulation tank.

In accordance with this invention, since the rod chamber of the cylinder and the pressure accumulation tank are communicated to each other by way of a pressure control valve mechanism so that a portion of pressurized air flowing backwardly from the head chamber to the pressure accumulation tank is recycled to the rod chamber, the pressure increase in the tank system communicating the head chamber with the pressure accumulation tank is moderated. This can significantly moderate the changes in the output from the cyliner to attain more uniform response in heavy load operation and during reciprocating stroke. In addition, since air is supplied from only one accumulation tank to the head chamber and the rod chamber for driving the cylinder, the pipeway arrangement can be simplified and the control section can be constituted with ease as a panel, which leads to the reduction in the initial cost. Further, since air in the head chamber is not released but only the air in the rod chamber is released to the external atmosphere during one reciprocation of the cylinder, and the air in the rod chamber is rendered to a low pressure by the reduction in the pressure control valve mechanism, the amount of air consumed can be decreased significantly and effective driving control can be attained with this decreased air consumption.

BRIEF DESCRIPTION OF THE DRAWINGS

The objects, features and advantageous effects of this invention will be made more clear by the following detailed descriptions referring to the accompanying drawings, wherein.

DESCRIPTION OF PREFERRED EMBODIMENT

Figure 1:
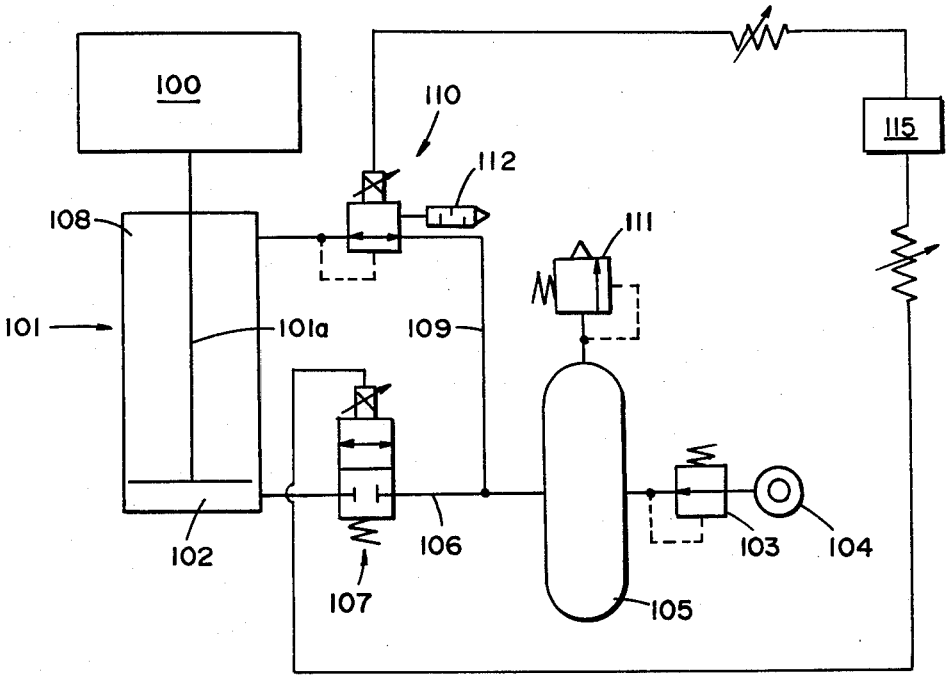
FIG. 1 is a circuit diagram for the first embodiment of this invention.

In FIG. 1, a cylinder 101 constitutes a lifting device for driving a load 100 upwardly and downwardly, in which a head chamber 102 in the cylinder 101 is communicated by way of a balance pipeway 106 equipped with an electromagnetic proportional flow control valve 107, the flow rate of which is in proportion to the value of energizing current, to a pressure accumulation tank 105 for accumulating the pressure from an air source 104 which is reduced to a predetermined level in a pressure reduction valve 103, and a rod chamber 108 in the cylinder 101 is communicated by way of a recycling pipeway 109 branched from the balance pipeway 106 and equipped with a pressure control valve mechanism 110 with the pressure accumulation tank 105. In the drawing, reference numeral 111 represents a relief valve for preventing abnormal pressure rise in the pressure accumulation tank 105 and reference numeral 112 represents a muffler. A remote control circuit 115, whose structure and function are well-known in the art provides selectively variable energizing currents to the electromagnetic proportional flow control valve 107 and the pressure control valve mechanism 110 by means of differential transformers, potentiometers, or as illustrated, by variable resistors.

The electromagnetic proportional flow control valve 107 is designed to close the balance pipeway 106 between the head chamber 102 and the pressure accumulation tank 105 upon de-energization and to open in a stepless manner, at a degree of opening in proportion to the value of energizing current, upon energization thereby causing fluid to flow from the pressure accumulation tank 105 into the head chamber 102 at a flow rate in proportion to the degree of opening, that is, the value of the current. Specifically, the control valve may take such a structure as shown in FIG. 2.

Figure 2:
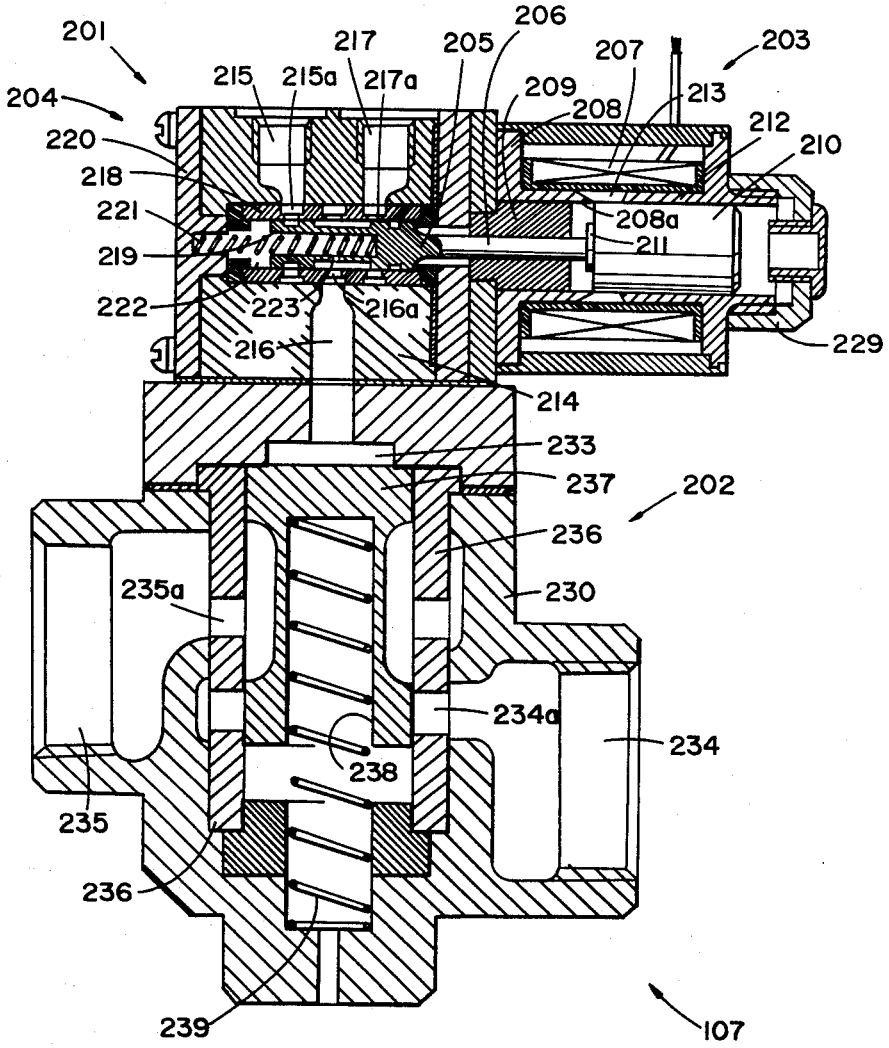
FIG. 2 is a cross sectional view of an electromagnetic proportional flow control valve in the fluid circuit shown in FIG. 1.

The electromgnetic flow control valve 107 shown in FIG. 2 comprises a pilot valve section 201 consisting of a solenoid section 203 and a valve section 204, and a main valve section 202. The solenoid section 203 has a structure wherein an axial rod 206 at one end of a pilot spool 205 is connected to a movable core 210 magnetically attracted to a stationary core 208 and a magnet pole piece 209 at one end of a coil 207, a de-magnetization plate 211 is disposed on the surface of the movable core 210 opposing the magnet pole piece 209, an edge is formed at an annular wall 208*a* of the stationary core 208 opposite to the guide pipe 212 by way of a gap 213 and the magnet pole piece 209 is tightly engaged.

Figure 3A:
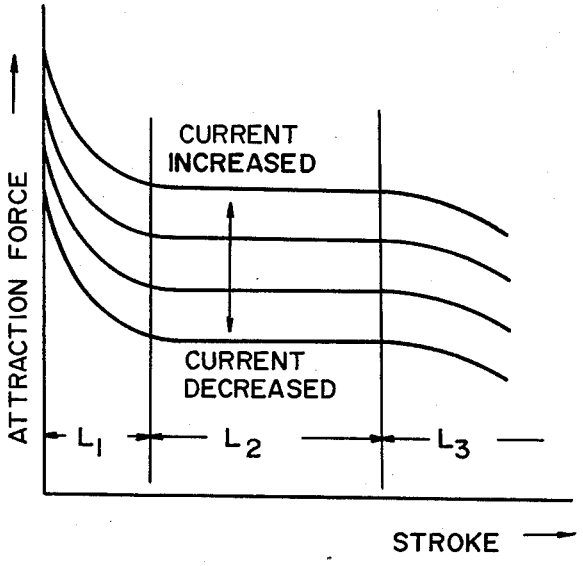
FIG. 3A is a diagram showing attraction characteristic of the solenoid in FIG. 2.

The solenoid section 203 with the foregoing structure has the attracting characteristic as shown in FIG. 3A. That is, the attracting force increases as the movable core 210 approaches the stationary core 208 mainly due to the attracting force between the movable core 210 and the magnet pole piece 209 upon energization in a range where the movable core 210 does not reach the edge of the annular wall 208*a* (in the stroke $L_3$). When the end face of the movable core 210 on the side of the magnetic pole piece 209 approaches the magnet pole piece 209 beyond the edge of the annular wall 208*a* of the stationary core 208, however, the radial attracting force between the movable core 210 and the annular wall 208*a* has such a component as to render the entire axial attracting force constant irrespective of the position of the stroke (in the stroke $L_2$). This is due to the fact that while the axial component of the attracting force between the movable core 210 and the annular wall 208*a* is exerted in the direction of increasing the attracting force between the movable core 210 and the stationary core 208 in a case where the distance between the cores is large, the axial component of the attracting force is exerted opposingly, in the direction of decreasing the attracting force between both of the cores, as the distance between the cores is decreased gradually within the range of the troke $L_2$.

If the movable core 210 is brought closer to the magnet pole piece 209 in the absence of the de-magnetization plate 211, the attracting force between them would be increased rapidly. Therefore, the de-magnetization plate 211 is provided for eliminating the range of the stroke $L_1$. The range of the stroke $L_3$ can be eliminated with ease by forming a stopper for the movable core 210 in a portion of a cover 229.

Figure 3B:
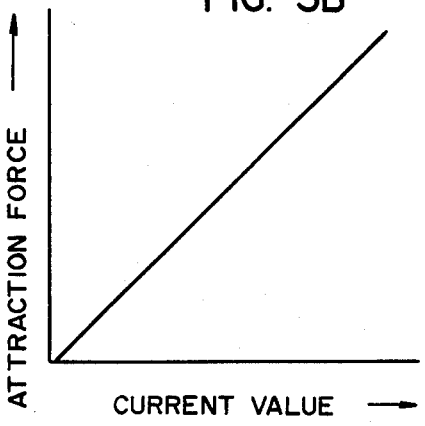
FIG. 3B is a diagram showing a proportional relation between the attracting force and the current value.

Since the attracting force is constant within the range of the stroke $L_2$, irrespective of the position in the stroke, a proportional relation as shown in FIG. 3B is presented between the current value supplied to the coil 207 and the attracting force exerted on the movable core 210.

A valve main body 214 in the valve section 204 has a pilot feed port 215, a pilot discharge port 216 and a breed port 217. Inside of the valve main body 214 is provided a sleeve 218 having a pilot feed opening 215*a*, a pilot discharge opening 216*a* and a breed opening 217*a* for communicating with the ports 215, 216, 217 respectively. The pilot spool 205 is fitted into the sleeve 218 and a return spring 221 is compressively mounted between a spring seat hole 219 formed in the spool 205 and an end cover 220. A back pressure chamber 222 containing the spring 221 is communicated with the pilot discharge port 216 by way of a feedback aperture 223 formed in the spool 205, so that the force due to the resiliency of the spring 221 and the pressure in the back pressure chamber 222 is balanced with the attracting force of the solenoid section 203 exerted on the movable core 210.

The main valve section 202 includes a valve main body 230 having a pressure actuation chamber 233 for communication with pilot discharge port 216, a fluid feed port 234 and a fluid discharge port 235 and a sleeve 236 disposed in the main body 230 and having a control opening 234*a* and a discharge opening 235*a* for communication with the ports 234 and 235 respectively. A spool 237 is fitted into the inside of the sleeve 236 for controlling the opening degree in a fluid channel between the feed port 234 which leads to the pressure accumulation tank 105 and the discharge port 235 which leads to the head chamber 102. A spring 239 is compressively mounted within a spring seat hole 238 formed in the spool 237.

When the coil 207 in the solenoid section 203 is supplied with energizing electric current, the movable core 210 is attracted to the stationary core 208 to an extent in proportion to the value of the energizing current under the balance between the resilient force of the spring 221 and the pressure in the back pressure chamber 222, and the attracting force of the coil 207. This causes the pilot spool 205 to move, whereby the breed opening 217*a* is closed and the pilot feed opening 215*a* is communicated with the pilot discharge opening 216*a* to introduce a secondary pressure in proportion to the value of the energization current into the pressure actuation chamber 233. The secondary pressure is also feedback by way of the feedback aperture 223 to the back pressure chamber 222. Then, the spool 237 in the main valve section 202 moves corresponding to the secondary pressure to a balanced position with the resilient force of the spring 239. This causes the control opening 234*a* in the sleeve 236 to open under stepless control from a fully closed state to a fully opened state thereby supplying air at a controlled flow rate from the feed port 234 which leads to the pressure accumulation tank 105 to the discharge port 235 which leads to the head chamber 102.

The pressure control valve mechanism 110 provided in the recycling pipeway 109 in FIG. 1 is constituted as an electromagnetic proportional pressure control valve whose output pressure is in proportion to the energizing current. The pressure control valve mechanism 110 is designed to close the recycling pipeway 109 between the rod chamber 108 and the pressure accumulation tank 105 and open the rod chamber 108 to external atmosphere in a de-energized state and, on the other hand, designed to communicate the rod chamber 108 with the pressure accumulation tank 105 thereby causing air to flow from the pressure accumulation tank 105 into the rod chamber 108 until the pressure in the rod chamber 108 arrives at a predetermined level in proportion to the value of the energizing current in an energized state. Specifically, the pressure control valve mechanism 110 may take such a structure as shown in FIG. 4.

Figure 4:
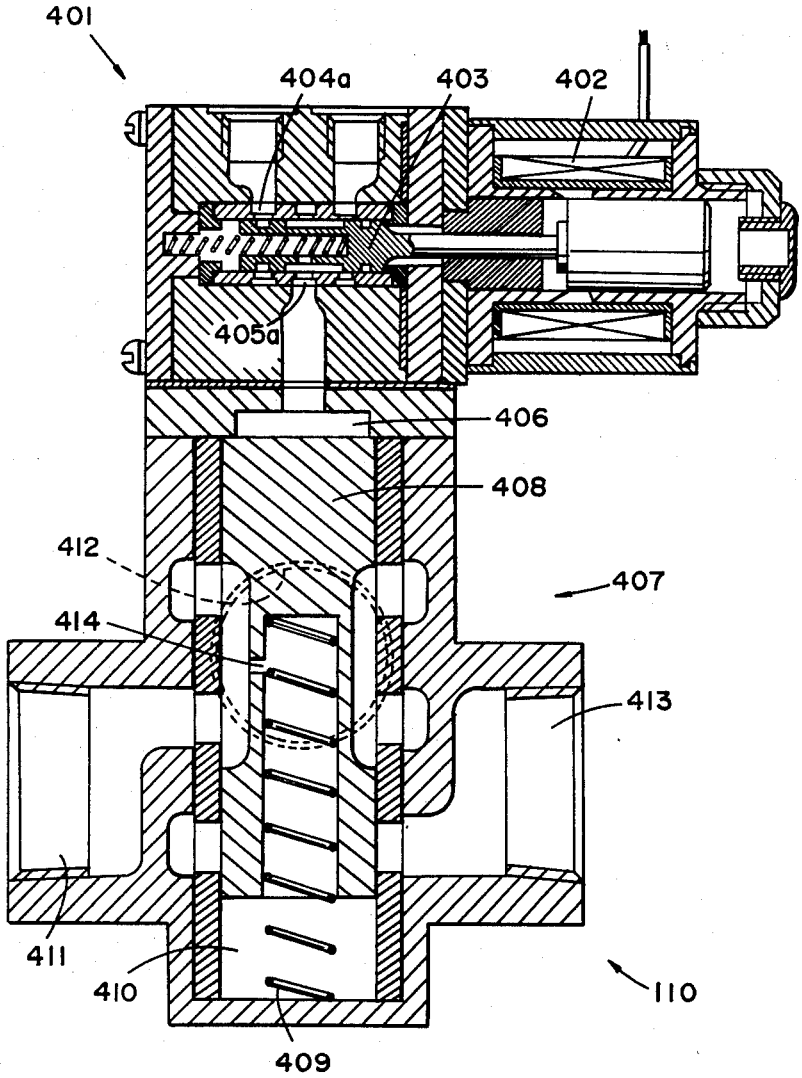
FIG. 4 is a cross sectional view of an electromagnetic proportional pressure control valve in the fluid circuit shown in FIG. 1, FIG. 5 and FIG. 6 are diagrams showing the results of the experiments according to this invention.

In the electromagnetic proportional pressure control valve shown in FIG. 4, when energizing current is supplied to a coil 402 in a pilot valve section 401, a secondary pressure in proportion to the value of the energizing current is introduced by the movement of a pilot spool 403 from a pilot feed opening 404*a* through a pilot discharge opening 405*a* into a pressure actuation chamber 406 in the same manner as FIG. 2, whereby a spool 408 in a main valve section 407 moves in response to the secondary pressure to a balanced position with respect to the resilient force of a spring 409 and a pressure in a back pressure chamber 410 containing the spring 409 that act against the secondary pressure. During this movement, the spool 408 closes a fluid channel between a discharge port 411 and a relief port 412 leading to external atmosphere and, then, communicates the discharge port 411 with a feed port 413 causing the fluid from the pressure accumulation tank 105 to flow from the feed port 413 through the discharge port 411 into the rod chamber 108 and causing the pressure at the discharge port 411 to be introduced by way of a feedback aperture 414 formed in the spool 408 to the back pressure chamber 410. This displaces the spool 408 to a position where the synthetic force of the pressure in the back pressure chamber 410 and the resilient force of the spring 409 is balanced with the secondary pressure in the pressure actuation chamber 406 to thereby set the pressure at the discharge port 411 to a decreased set value in proportion to the valve of the energizing current.

In the cylinder driving apparatus having the foregoing configuration, neither the head chamber 102 nor the rod chamber 108 communicates with the pressure accumulation tank 105 and the rod chamber 108 is kept open to the external atmosphere when the electromagnetic proportional flow control valve 107 and the pressure control valve mechanism 110 are in the de-energized state.

When an energizing current is supplied to the electromagnetic proportional flow control valve 107 in this state, an amount of air corresponding to the value of the energizing current flows from the pressure accumulation tank 105 to the head chamber 102, and a cylinder rod 101*a* moves in an upward stroke at a speed corresponding to the flow rate while supporting the load 100. Along with the upwardly movement, air in the rod chamber 108 is released by way of the pressure control valve mechanism 110 to the external atmosphere and, simultaneously, air in an amount for compensating the pressure reduction in the pressure accumulation tank 105, which resulted from the increase in the capacity of the head chamber 102, is supplemented from the air source 104 by way of the pressure reduction valve 103 to the pressure accumulation tank 105.

Thereafter, the load 100 can be moved downwardly by supplying an energizing current to the pressure control valve mechanism 110 to reduce and supply the pressure from the pressure accumulation tank 105 to the rod chamber 108, while keeping the electromagnetic proportional flow control valve 107 energized to communicate the head chamber 102 with the pressure accumulation tank 105. Thus, the force due to the reduced pressure from the pressure accumulation tank 105 joins the force of the load 100 on the side of the rod chamber 108 in the cylinder 101 to overcome the force on the side of the head chamber 102 thereby moving the load 100 downwardly. The downward speed can be controlled by the value of the energizing current to the pressure control valve mechanism 110 and the electromagnetic proportional flow control valve 107. The pressure in the pressure accumulation tank 105 is increased by the pressurized air returned from the head chamber 102 by way of the balance pipeway 106 to the pressure accumulation tank 105 with the downward movement of the load 100. However, since the pressure accumulation tank 105 is communicated with the rod chamber 108 by way of the recycling pipeway 109, a portion of the air returning to the pressure accumulation tank 105 is recycled into the rod chamber 108 to suppress the pressure rise in the pressure accumulation tank 105.

The speed of the load 100 can be controlled during upward and downward strokes by changes in the value of the energizing current to the electromagnetic proportional flow control valve 107, and this enables high speed movement midway in the stroke, buffered stopping at the stroke ends and emergency stopping during stroking movement.

Explanation will be made for experimental examples carried out for the cylinder driving apparatus discussed hereinabove.

[Condition for Experiment]

Load Weight: 1,000 kgf

Cylinder: inner diameter 200 mm, rod diameter 50 mm, stroke 1,000 mm

Pressure accumulation tank: 200 l

When the cylinder 101 is operated under the above conditions while setting the lower limit for the pressure in the pressure accumulation tank 105 to 4.0 kgf/cm$^2$ by the pressure reduction valve 103, the pressure Pr (pressure in the rod chamber 108) is set by the electromagnetic proportional pressure control valve 110 to 2 kgf/cm$^2$, air is consumed in the cylinder 101 during one reciprocating cycle of the load only for low pressure air at 2 kgf/cm$^2$ discharged from the rod chamber 108. The amount of the discharged air is 86.4 (Nl/reciprocation), which corresponds to 23.5% of air consumption of 367 (Nl/one reciprocation) in conventional case where high pressure air at 5 kgf/cm$^2$ is discharged, and operating costs amounting to as much as 76.5% can be saved in one reciprocation of the cylinder 101.

Figure 5:
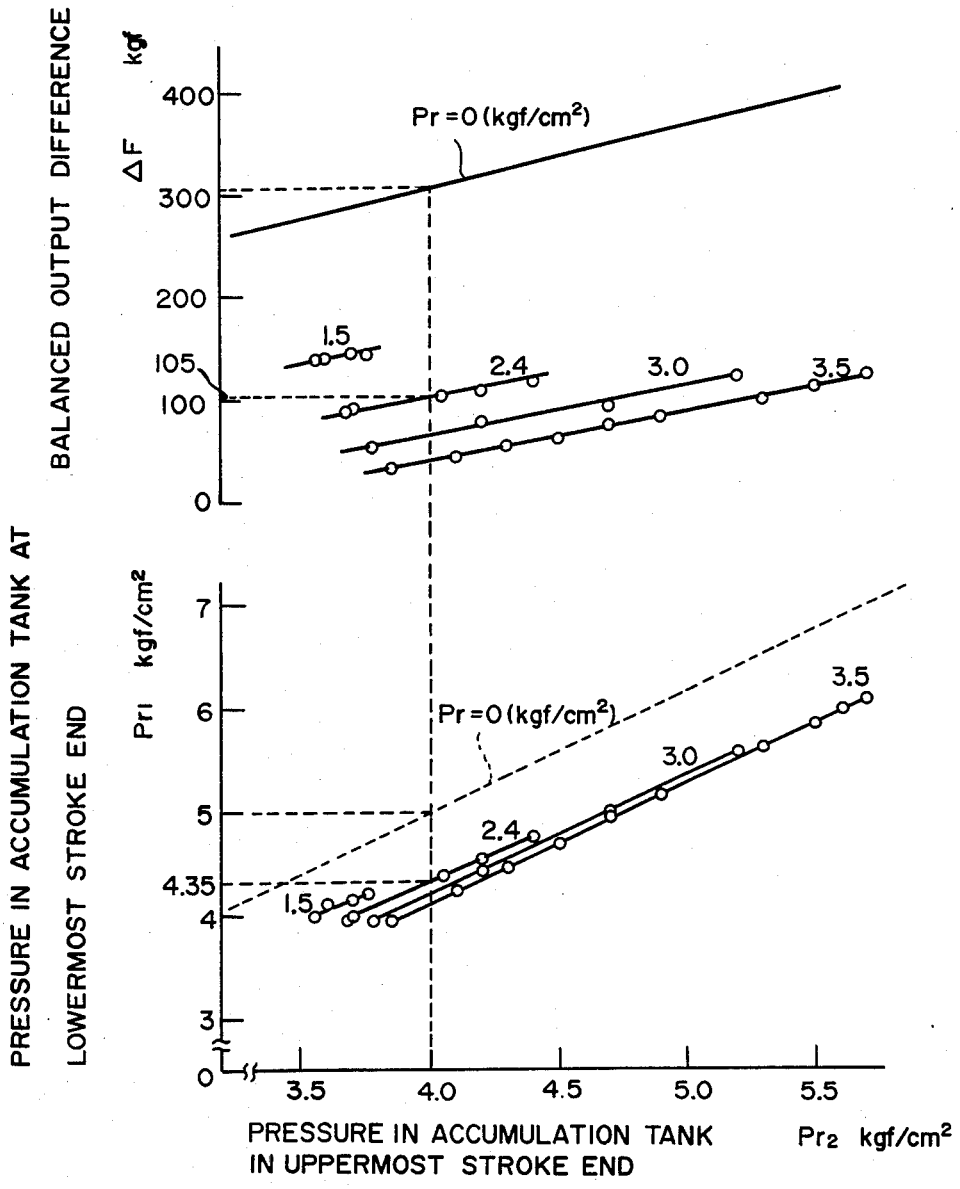

FIG. 5 shows the result of the experiments under the experimental condition referred to above, wherein the diagram in the lower portion of the figure represents the the relation between pressure $P_{T1}$ in the pressure accumulation tank 105 at the lowermost stroke end and pressure $P_{T2}$ in the pressure accumulation tank 105 at the uppermost stroke end where the load is moved downwardly from the uppermost stroke end to the lowermost stroke end, while using the pressure Pr set by the electromagnetic proportional pressure control valve 110 as a parameter, and the diagram in the upper portion of the figure represents a relation between balanced output difference at the uppermost and the lowermost stroke ends: $\Delta F = A\eta\,(P_{T1} - P_{T2})$ and the pressure $P_{T2}$ in the pressure accumulation tank 105 and wherein $A\eta$ is an effective area of a piston in the cylinder 101.

These diagrams show the changes of the pressure in the pressure accumulation tank 105 when the piston moves to the uppermost and the lowermost stroke ends, wherein recycling of the air to the rod chamber 108 significantly relaxes the pressure increase in the pressure accumulation tank 105 during downward stroke and, consequently, the balance output difference $\Delta F$ in the head chamber is also relaxed. For instance assuming $P_{T2}=4$ kgf/cm$^2$ and $Pr=2.4$ kgf/cm$^2$, the pressure $P_{T1}$ in the pressure accumulation tank 105 after the downward stroke is increased, by 0.35 kgf/cm$^2$, to 4.35 kgf/cm$^2$ and the cylinder 101 output increases only by 105 kgf, which corresponds to $\frac{1}{3}$ increase with respect to a reference case where $Pr=0$ (no recycling). It is thus apparent that more uniform response can be attained in heavy load operation and during reciprocating driving.

Figure 6:
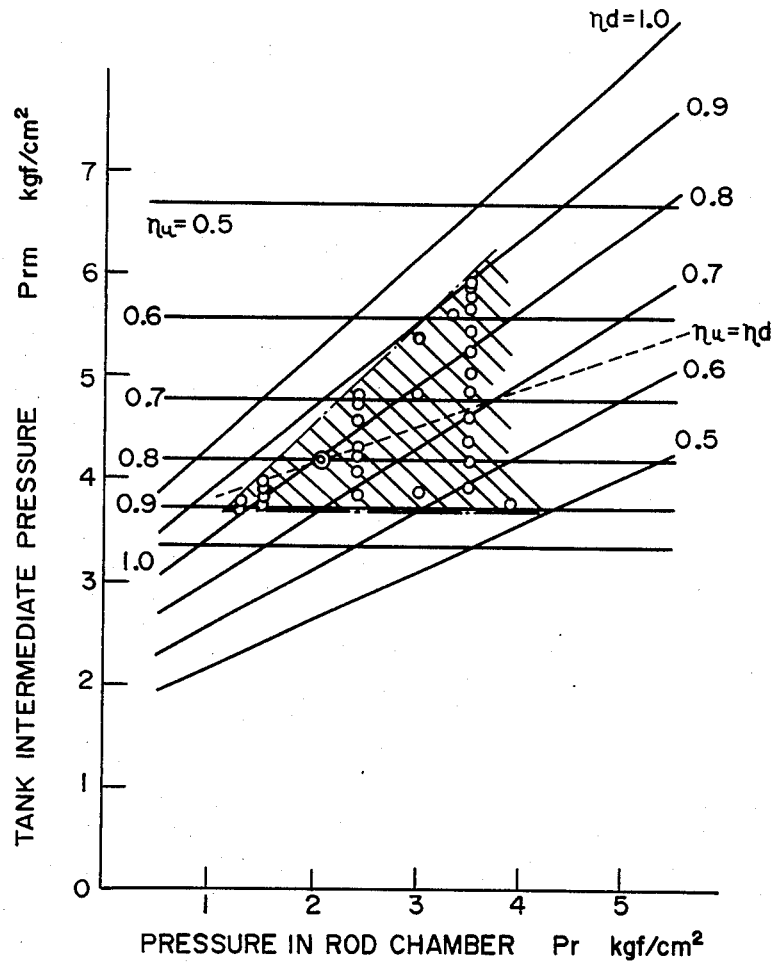

FIG. 6 shows the results of the experiments for the operation point of the cylinder 101, wherein a symbol o in the drawing shows the point that the full stroke of the cylinder 101 in the reciprocation driving were operated, consequently, the cylinder 101 could not move fully in the forward direction in the region below the horizontal line of the hatched area and could not fully return as well in the region above the oblique line of the hatched area. It is thus confirmed that the operation points may be selected within a range between the horizontal line and the oblique line. This means that heavy load operation is possible with load factor in the apparatus $\eta \approx 90\%$ in the upward movement and with the load factor in the apparatus $\eta d \approx 80-90\%$ in the downward movement. As shown by the symbol ⊙ in the diagram, for example, very effective operation can be expected by selecting the operation point as below:

load factor in the apparatus $\eta u=\eta d=0.80$ intermediate pressure in the tank $P_{Tm}=\frac{1}{2}(P_{T1}+P_{T2})=4.2$ kgf/cm$^2$ ($P_{T1}=4.4$, $P_{T2}=4.0$)

set pressure for recycling flow: $Pr=2$ kgf/cm$^2$

Figure 7:
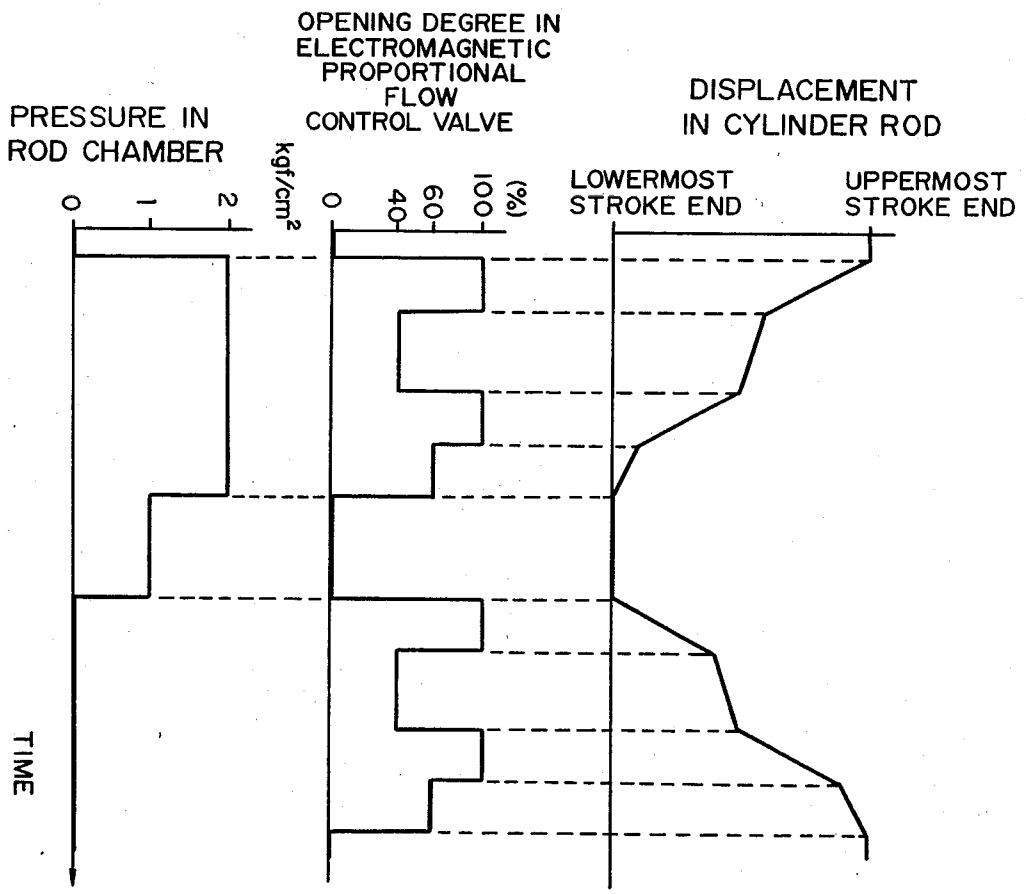
FIG. 7 is a diagram showing an example for the control of driving according to this invention.

FIG. 7 typically shows a control example for the cylinder driving apparatus of this embodiment, wherein the cylinder rod 101*a* is moved downwardly from the uppermost stroke end to the lowermost stroke end and then again moved upwardly to the uppermost stroke end. It is effective to decrease the set pressure Pr to some extent after the cylinder rod 101 has been moved downwardly for decreasing the delay in the succeeding stroke.

Figure 8:
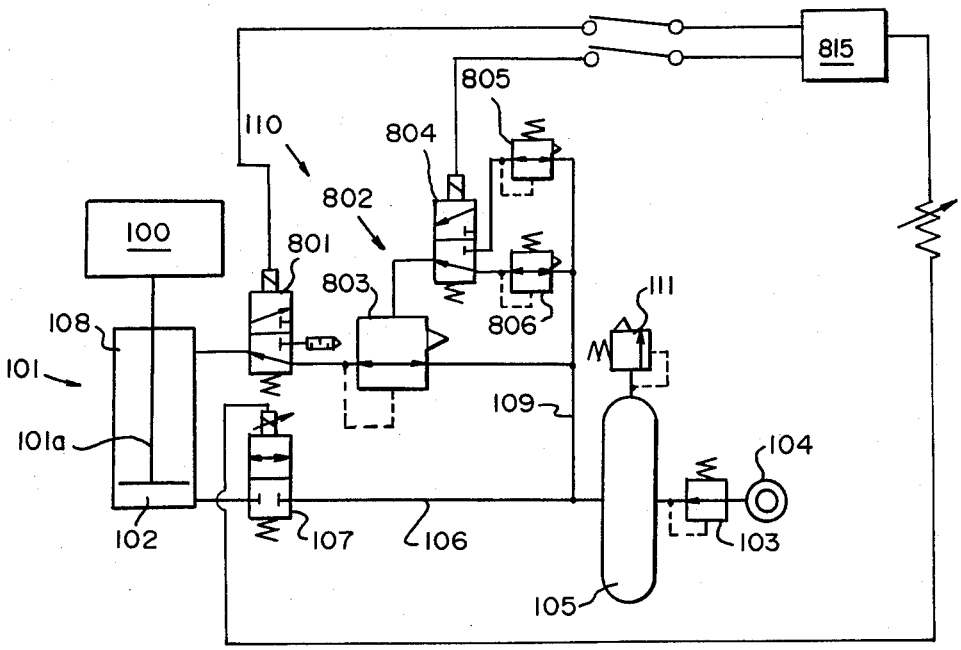
FIG. 8 is a circuit diagram for the second embodiment of this invention.

FIG. 8 shows the second embodiment of this invention, wherein a pressure control valve mechanism 110 is constituted by replacing one electromagnetic proportional pressure control valve having two functions of air charge and discharge and pressure reduction used in the first embodiment for a 3-port electromagnetic valve 801 adapted to conduct only for air charge and discharge and a pilot type pressure reduction valve 802 adapted to reduce pressure stepwise in combination.

The pilot type pressure reduction valve 802 comprises a main pressure reduction valve 803 which reduces the pressure in the pressure accumulation tank 105 and transfers it to the input of the 3-port electromagnetic valve 801 and a 3-port electromagnetic valve 804 which selects one of a plurality of pressure reduction valves 805, 806 having different pressure reduction ratios for applying a plurality of different pilot pressures selectively to the main pressure reduction valve 803. In a case where the load 100 is moved upwardly from the lowermost stroke end, the 3-port electromagnetic valve 801 for air charge and discharge is energized to open the rod chamber 108 to the external atmosphere and, at the same time, the electromagnetic proportional flow control valve 107 is energized causing air to flow from the accumulation tank 105 into the head chamber 102.

In an opposite case where the load 100 is moved downwardly from the uppermost stroke end, the 3-port electromagnetic valve 801 for air charge and discharge is de-energized to communicate its input with the rod chamber 108 while keeping the electromagnetic proportional flow control valve 107 energized to communicate the head chamber 102 with the pressure accumulation tank 105 and, at the same, the pilot pressure applied to the main pressure reduction valve 803 is selected by switching the 3-port electromagnetic valve 804 and the reduced pressure output corresponding to the pilot pressure is applied to the rod chamber 108 by way of the 3-port valve 801 for air charge and discharge. A remote control circuit 815, similar to the remote control circuit 115 of FIG. 1, provides energizing current for the operation of the electromagnetic proportional flow control valve 107, the 3-port electromagentic valve 801 and the 3-port electromagnetic valve 804.

Other portions in the second embodiment having the same reference numerals as those in the first embodiment have substantially the same constitutions and functions as the corresponding portion and, therefore, the detailed descriptions are not made.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cylinder driving apparatus for driving a load upwardly and downwardly, said cylinder driving apparatus comprising:

(a) a pneumatic cylinder divided into a first chamber and a second chamber by a piston, said cylinder further comprising a load supporting rod operatively connected to said piston, said cylinder being arranged such that an increase in pressure in said first chamber causes the rod to move upwardly and an increase in pressure in said second chamber causes the rod to move downwardly;

(b) a pressure accumulation tank;

(c) means for supplying pressurized air at a selected pressure to said pressure accumulation tank;

(d) a balance pipeway communicating said first chamber to said pressure accumulation tank;

(e) second means for generating a selectively variable first energizing current;

(f) third means for generating a second energizing current;

(g) a first electromagnetic proportional flow control valve operatively disposed in said balance pipeway, said first electromagnetic proportional flow control valve being selectively movable between a first position in which it prevents communication between said first chamber and said pressure accumulation tank and a second position in which it regulates air flow between said first chamber and said pressure accumulation tank in proportion to said first energizing current;

(h) a recycling pipeway communicating said second chamber to said pressure accumulation tank; and (i) a pressure control valve mechanism operatively disposed in said recycling pipeway, said pressure control valve mechanism being selectively movable in response to said second energizing current between a first position in which it communicates said second chamber with the atmosphere and a second position in which it blocks flow through said recycling pipeway, wherein said pressure control valve mechanism comprises:

(a) a three-port electromagnetic valve for pneumatic charge and discharge and (b) a pilot type pressure reduction valve for providing pilot pressure, said pilot type pressure reduction valve including pressure reduction valves set at different pressure levels by a switching valve such that when the load is moved upwardly said three-port electromagnetic valve is energized to place said second chamber in fluid communication with said relief valve, and, during downward movement of the load, said three-port electromagnetic valve is de-energized to communicate said second chamber with pressure from said pressure accumulation tank which is modulated by said pilot pressure, whereby, during use of said cylinder driving apparatus:

(j) the load supporting rod is moved downwardly by a combination of the air pressure in said second chamber and the force of gravity acting on the load, both of which act against the air pressure in said first chamber, and (k) a backward pressurized air flow from said first chamber to said pressure accumulation tank during downward movement of the load supporting rod is partially recycled to said second chamber via said recycling pipeway.

2. A cylinder driving apparatus for driving a load upwardly and downwardly, said cylinder driving apparatus comprising:

(a) a pneumatic cylinder divided into a first chamber and a second chamber by a piston, said cylinder further comprising a load supporting rod operatively connected to said piston, said cylinder being arranged such that an increase in pressure in said first chamber causes the rod to move upwardly and an increase in pressure in said second chamber causes the rod to move downwardly;

(b) a pressure accumulation tank;

(c) means for supplying pressurized air at a selected pressure to said pressure accumulation tank;

(d) a balance pipeway communicating said first chamber to said pressure accumulation tank;

(e) second means for generating a selectively variable first energizing current;

(f) third means for generating a second energizing current;

(g) a first electromagnetic proportional flow control valve operatively disposed in said balance pipeway, said first electromagnetic proportional flow control valve being selectively movable between a first position in which it prevents communication between said first chamber and said pressure accumulation tank and a second position in which it regulates air flow between said first chamber and said pressure accumulation tank in proportion to said first energizing current;

(h) a recycling pipeway communicating said second chamber to said pressure accumulation tank; and (i) a pressure control valve mechanism operatively disposed in said recycling pipeway, said pressure control valve mechanism being selectively movable in response to said second energizing current between a first postiion in which it communicates said second chamber with the atmosphere and a second position in which it blocks flow through said recycling pipeway, wherein said pressure control valve mechanism comprises:

(a) a two-position flow control valve operatively disposed in said recycling pipeway, said two-position flow control valve being selectively movable between a first position in which it permits air flow between said second chamber and said pressure accumulation tank and a second position in which it permits air flow between said second chamber and atmosphere;

(b) a main pressure reduction valve operatively disposed in said recycling pipeway between said two-position flow control valve and said pressure accumulation tank, said main pressure reduction valve serving to reduce the pressure transmitted to said second chamber through said recycling pipeway;

(c) a switching valve in fluid communication with said main pressure reduction valve and with said pressure reduction tank; and (d) a plurality of secondary pressure reduction valves having different pressure reduction ratios, said plurality of secondary pressure reduction valves being disposed in parallel between said pressure accumulation tank and said switching valve such that, during use of said cylinder driving apparatus, said switching valve may be used to communicate said pressure reduction valve through a selected one of said plurality of secondary pressure reduction valves, whereby, during use of said cylinder driving apparatus:

(j) the load supporting rod is moved donwardly by a combination of the air pressure in said second chamber and the force of gravity acting on the load, both of which act against the air pressure in said first chamber, and (k) a backward pressurized air flow from said first chamber to said pressure accumulation tank during downward movement of the load supporting rod is partially recycled to said second chamber via said recycling pipeway.

3. A cylinder driving apparatus including a cylinder having a head chamber and a rod chamber for driving a load upwardly and downwardly and a pressure accumulation tank for accumulating pressurized air to drive said load, said cylinder driving apparatus comprising:

a balance pipeway communicating said head chamber with said pressure accumulation tank so as to accumulate pressurized air which is regulated at a pressure level necessary to maintain said load at an uppermost position;

means for generating a selectively variable first energizing current;

means for generating a second energizing current;

a two-port electromagnetic proportional flow control valve associated with said balance pipeway for controlling upward and downward movement of said load by regulating a first pressurized air flow between said head chamber and said pressure accumulation tank, wherein said two-part electromagnetic proportional flow control valve further comprises means for producing said first pressurized air flow proportional to said first energizing current supplied to said electromagnetic proportional flow control valve;

a recycling pipeway communicating said rod chamber with said pressure accumulation tank; and a pressure control valve mechanism associated with said recycling pipeway for controlling upward and downward movement of said load by alternately communicating said rod chamber with said pressure accumulation tank and the atmosphere and wherein said pressure control valve mechanism further comprises means for producing a reduced second pressurized air flow from said pressure accumulation tank to said rod chamber as a function of said second energizing current supplied to said pressure control valve mechanism, such that said load is moved downwardly by the second air pressure in said rod chamber together with the force of gravity acting on said load against the first air pressure in said head chamber, and a backward pressurized air flow from said head chamber to said pressure accumulation tank during downward movement of said load is partially recycled to said chamber via said recycling pipeway, wherein said means for producing a reduced second pressurized air flow comprises a three-port electromagnetic valve for air charge and discharge and a pilot type pressure reduction valve for providing reduced pressure corresponding to a pilot pressure said pilot type pressure reduction valve including pressure reduction valves set at different pressure levels by a switching valve, such that when said load is moved upwardly said three-port electromagnetic valve is energized to open said rod chamber to the atmosphere and, during downward movement of said load, said three-port electromagnetic valve is de-energized to communicate said rod chamber with said pilot pressure from said pilot type pressure reduction valve.

4. The cylinder driving apparatus as claimed in claim 3 wherein said pressure control valve mechanism further comprises an electromagnetic proportional pressure control valve having a proportional type solenoid generating an attracting force in proportion to said second energizing current, a pilot valve section driven by said proportional type solenoid to generate a secondary pressure proportional to said second energizing current, and a main valve section responsive to said secondary pressure, said main valve section including a spring disposed therein, a back pressure chamber, a spool, a feed port, a discharge port and a relief port such that said spool is driven to a balanced position by said secondary pressure, a resilient force of said spring and a back pressure in said back pressure chamber to alternately communicate said feed port with said discharge port and said discharge port with said relief port leading to the atmosphere.

5. A cylinder driving apparatus for driving a load upwardly and downwardly, said cylinder driving apparatus comprising:

(a) a pneumatic cylinder divided into a first chamber and a second chamber by a piston, said cylinder further comprising a load supporting rod operatively connected to said piston, said cylinder being arranged such that an increase in pressure in said first chamber causes the rod to move upwardly and an increase in pressure in said second chamber causes the rod to move downwardly;

(b) a pressure accumulation tank;

(c) means for supplying pressurized air at a selected pressure to said pressure accumulation tank;

(d) a balance pipeway communicating said first chamber to said pressure accumulation tank;

(e) second means for generating a selectively variable first energizing current;

(f) third means for generating a selectively variable second energizing current;

(g) a first electromagnetic proportional flow control valve operatively disposed in said balance pipeway, said first electromagnetic proportional flow control valve being selectively movable between a first position in which it prevents communication between said first chamber and said pressure accumulation tank and a second position in which it regulates air flow between said first chamber and said pressure accumulation tank in proportion to said first energizing current;

(h) a recycling pipeway communicating said second chamber to said pressure accumulation tank; and (i) a pressure control valve mechanism operatively disposed in said recycling pipeway, said pressure control valve mechanism being selectively movable between a first position in which it communicates said second chamber with the atmosphere and a second position in which it blocks flow through said recycling pipeway, wherein said pressure control valve mechanism includes a second electromagnetic proportional flow control valve, said second electromagnetic proportional flow control valve comprising:

(a) a proportional type solenoid which generates an attracting force in proportion to said second energizing current;

(b) a pilot valve section driven by said proportional type solenoid so as to produce a pilot pressure proportional to said second energizing current; and (c) a main valve section responsive to said pilot pressure, said main valve section comprising:

(i) a sleeve containing a relief port in fluid communication with the atmosphere, a feed port in fluid communication with said pressure accumulation tank, and a discharge port in fluid communication with said second chamber;

(ii) a spool slidably disposed in said sleeve, said spool having a first pressure applicable area against which said pilot pressure bears when said pilot pressure section produces said pilot pressure and a second pressure applicable area against which the pressure in said discharge port bears via a feedback aperture in said spool; and (iii) a spring which bears against said spool in the same direction as the pressure in said discharge port, said sleeve and said spool being sized and shaped so as to alternately communicate said feed port with said discharge port and said discharge port with said relief port, whereby said spool is driven to a balance position defined by said pilot pressure acting on said spool in one direction and the pressure in said discharge port and the force of said spring acting on said spool in the other direction, and whereby, during use of said cylinder driving apparatus:

(j) the load supportng rod is moved downwardly by a combination of the air pressure in said second chamber and the force of gravity acting on the load, both of which act against the air pressure in said first chamber, and (k) a backward pressurized air flow from said first chamber to said pressure accumulation tank during downward movement of the load supporting rod is partially recycled to said second chamber via said recycling pipeway.

6. A cylinder driving apparatus as recited in claim 5 wherein:

(a) said first chamber is the head chamber of said pneumatic cylinder and (b) said second chamber is the rod chamber of said pneumatic cylinder.

7. A cylinder driving apparatus as recited in claim 5 wherein said first electromagnetic proportional flow control valve is a two-port valve.

8. A cylinder driving apparatus as recited in claim 5 wherein:

(a) said first electromagnetic proportional flow control valve is in its first position when said first energizing current is zero and (b) said pressure control valve mechanism is in its first position when said second energizing current is zero.

* * * * *